US006033294A

United States Patent [19]

Tsai

[11] Patent Number: 6,033,294

[45] Date of Patent: Mar. 7, 2000

[54] TURNTABLE OF NYLON FIBER GRINDING WHEEL

[76] Inventor: Chin Yuan Tsai, 3 N. Lane, Dah Shuh Rd., Kaoshiung Hsien, Taiwan

[21] Appl. No.: 08/969,303

[22] Filed: Nov. 13, 1997

[51] Int. Cl.[7] ..... B24D 17/00

[52] U.S. Cl. ..... 451/508; 451/540

[58] Field of Search ..... 451/508, 540, 451/548, 526, 539, 532, 509, 510; 51/298; 156/345 LP

[56] References Cited

U.S. PATENT DOCUMENTS

| | | | |
|---|---|---|---|
| 3,081,584 | 3/1963 | Bullard | 451/548 |
| 3,136,100 | 6/1964 | Robertson, Jr. | 451/548 |
| 4,878,316 | 11/1989 | Mackay, Jr. | 451/548 |

*Primary Examiner*—David A. Scherbel
*Assistant Examiner*—Derris Holt Banks
*Attorney, Agent, or Firm*—David and Raymond; Raymond Y. Chan

[57] ABSTRACT

An improved turntable of a nylon fiber grinding wheel, which is integrally made of plastic by injection has a predetermined amount of flexibility. The turntable has a locking hole provided at a center portion therethrough, and a ring groove encircling the locking hole on a top surface of the turntable. The ring groove has a plurality of through slot arranged spacedly and radially and defines a plurality of ribs arranged radially and respectively between the through slots. A bottom surface recess of the turntable and ring groove are overfilled with a gluing agent such as epoxy resin, so that the gluing agent would also fill in the plurality of through slots and enwrap around the plurality of ribs. Therefore, a nylon fiber grinding plate can be attached to the bottom surface recess of the turntable by means of the gluing agent. As the gluing agent is enwrapped around the plurality of ribs around the through slot, the solidified gluing agent would be in an I-shape which ensures a rigid connection between the turntable and the nylon fiber grinding plate as strong as being riveted. Therefore, the resistance force contract the torque force generated by the turning motion between the grinding surface and the working surface is increased, and thus the maximum turning speed of the whole grinding wheel can be also increased.

4 Claims, 5 Drawing Sheets

TURNTABLE OF NYLON FIBER GRINDING WHEEL

FIELD OF THE PRESENT INVENTION

The present invention relates to an improved turntable of a nylon fiber grinding wheel, and more particularly to a turntable to which a nylon fiber grinding wheel can be more tightly and rigidly attached by a gluing agent such as epoxy resin.

BACKGROUND OF THE PRESENT INVENTION

The conventional method for grinding work is well known by using the sand paper or sand cloth to complete. In the recent years, people in this field have invented a new structural grinding body by using the nylon fiber for grinding work. When this type of grinding body are at work, a large amount of rubbish would be generated and settled into the pores of the nylon fiber. But as the rotation of the grinding body continues, the centrifugal force generated by the rotating grinding machine would spin out all the rubbish from the grinding body, and thus no rubbish would be left on the grinding surface.

The conventional sand cloth or sand paper has a fine and well defined structure on the grinding surface. During the grinding process, a portion of the rubbish would build up on the grinding surface. The sand paper and sand cloth can not effectively remove the continuously generating rubbish. Therefore, as the grinding process continues, the effectiveness and grinding ability of the sand paper and sand cloth decreased. Due to the facts that the grinding body made of nylon fiber has many advantages and the strength of the nylon fiber is far better than the conventional sand cloth or sand paper, the nylon fiber grinding body has gradually replaced the traditional sand paper or sand cloth. Also the grinding body can be mounted on a turntable that is screwed on a handheld grinding machine, so that the high speed turning motion of the handheld grinding machine can drive the grinding body to rotate and effectively and efficiently provide a better and faster work.

In accordance with the above description, the conventional nylon fiber grinding wheel 10 (as shown in FIG. 1) comprises a nylon fiber grinding plate 11, and a turntable 12 is attached to the nylon fiber grinding plate 11 by a gluing agent A, wherein the turntable 12 has a screw hole 13 centrally provided thereon for a turning axle 21 of the handheld grinding machine to pass through. The nylon fiber grinding wheel 10 is screwed on the turning axle 21 of the handheld grinding machine by a locking cylinder 22. When the handheld grinding machine is turned on, the turning axle 21 of the handheld grinding machine would drive the nylon fiber grinding plate to rotate for grinding purpose.

However, during the grinding process, the nylon fiber grinding wheel 10 and the grinding surface would generate a torque force therebetween. The ability to resist the torque force is limited by the resistance force between the gluing agent A and the turntable 12 because that is the weakest part of the connection. As the grinding speed increases, the torque force generated between the nylon fiber grinding wheel 10 and the grinding surface would also increase. When the torque force exceeds the resistance force between the gluing agent A and the turntable 12, the turntable 12 would not be able to stay attached to the nylon fiber grinding plate 11, and thus the nylon fiber grinding plate 11 would be separated from the nylon fiber grinding wheel 10 (at this time, the turntable 12 is still screwed on the turning axle 21 of the handheld grinding machine). In view of the above disclosure, we know that the conventional nylon fiber grinding wheel 10 is only attached to a flat bottom surface of the turntable 12 by the gluing agent A. The resistance force generated by this type of connection is only adequate for grinding work at slower speed rotation below 5,000 rpm. When the turning speed is more than 5,000 rpm, there is a great chance that the resistance force would be unable to withstand the torque force and cease the grinding process.

As shown in FIG. 2, another type of conventional turntable 30 is illustrated. The turntable 30 has radially provided a plurality of through holes 31 on its surface. When the turntable 30 is attached to the nylon fiber grinding plate 11 by the gluing agent A, the gluing agent A would fill the contact surface between the turntable 30 and the nylon fiber grinding plate 11, and that a portion of the gluing agent A would also fill the plurality of through holes 31 of the turntable 30. The gluing agent A which fills the through holes 31 would create a greater bonding ability between the turntable 30 and the nylon fiber grinding plate 11 (as shown in FIG. 3). When the contact area increases, the turntable 30 and the gluing agent A would also increase the resistance force that enables the nylon fiber grinding plate being driven to rotate at a higher speed between 5,000 rpm to 7,000 rpm during grinding operation.

The truning speed of the grinding machine and the work processing speed are in direct proportion. The higher the grinding machine can turn, the faster the grinding work can be completed. All the above described conventional nylon fiber grinding plate can only be worked at an ideal turning speed of 7,000 rpm and under. What if we can increase the turning speed of the grinding machine to a degree that the nylon fiber grinding plate and the turntable can handle? Then for sure we can speed up the grinding process and achieve better grinding performance.

SUMMARY OF THE PRESENT INVENTION

The main objective of the present invention is to provide an improved turntable of a nylon fiber grinding wheel, which is designed for enabling the nylon fiber grinding plate to firmly and tightly mounted thereon and providing a higher torque resistance force therebetween during the grinding operation, so that the nylon fiber grinding plate is adapted to run at higher turning speed at approximately 20,000 rpm. The improved turntable of nylon fiber grinding wheel can thus be effectively and efficiently provided a better and faster work.

Accordingly, an improved turntable of a nylon fiber grinding wheel, which is integrally made of plastic by injection has a predetermined amount of flexibility. The turntable has a locking hole provided at a center portion therethrough, and a ring groove encircling the locking hole on a top surface of the turntable. The ring groove has a plurality of through slot arranged spacedly and radially and defines a plurality of ribs arranged radially and respectively between the through slots. A bottom surface recess of the turntable and ring groove are overfilled with a gluing agent such as epoxy resin, so that the gluing agent would also fill in the plurality of through slots and enwrap around the plurality of ribs. Therefore, a nylon fiber grinding plate can be attached to the bottom surface recess of the turntable by means of the gluing agent. As the gluing agent is enwrapped around the plurality of ribs around the through slot, the solidified gluing agent would be in an I-shape which ensures a rigid connection between the turntable and the nylon fiber grinding plate as strong as being riveted. Therefore, the resistance force contract the torque force generated by the turning motion between the grinding surface and the working surface is increased, and thus the maximum turning speed of the whole grinding wheel can be also increased.

DETAILED DESCRIPTION OF THE PREFERRED EMBODIMENT

Figure 1:
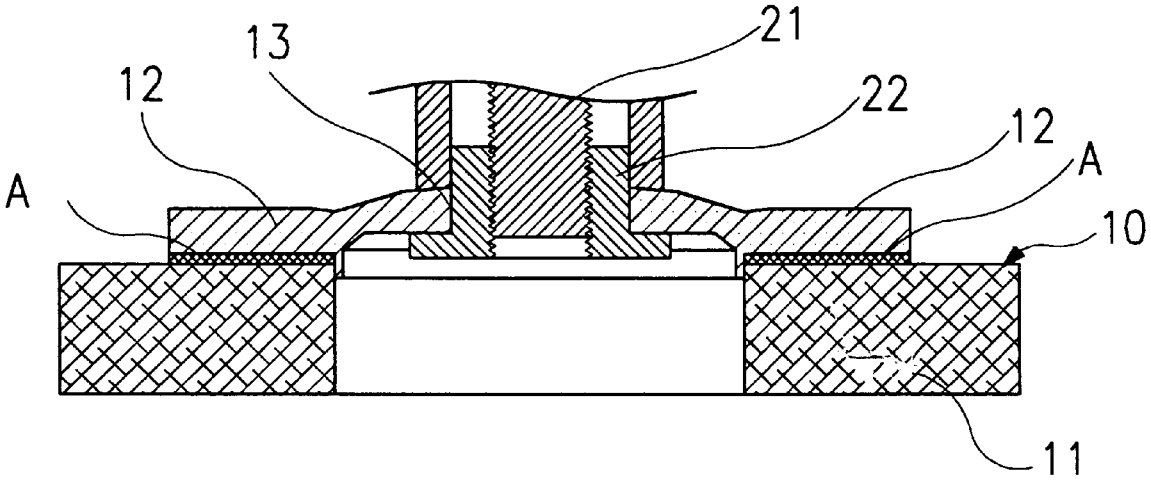
Fig. 1 PRIOR ART
FIG. 1 is a sectional view of a conventional nylon fiber grinding plate screwed on a turning axle of a handheld grinding machine.
Figure 2:
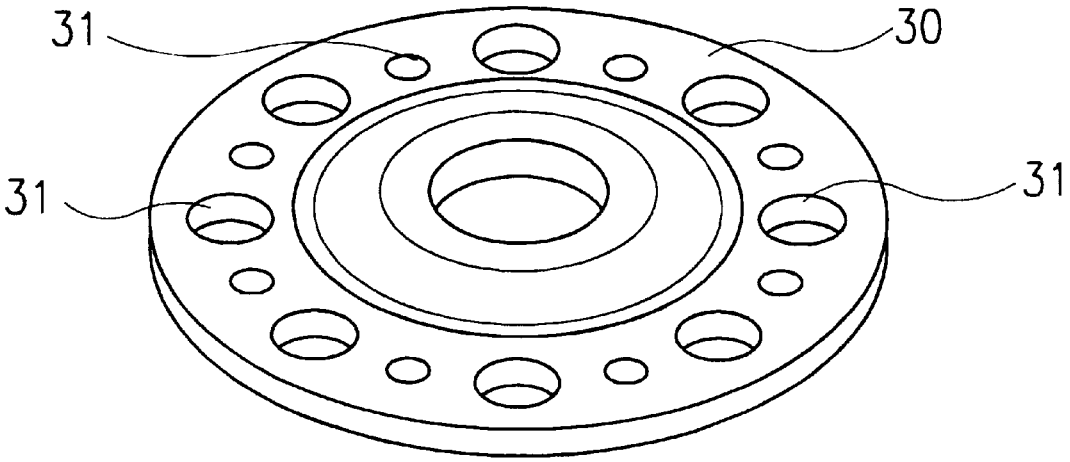
Fig. 2 PRIOR ART
FIG. 2 is a perspective view of another conventional turntable for nylon fiber grinding plate.
Figure 3:
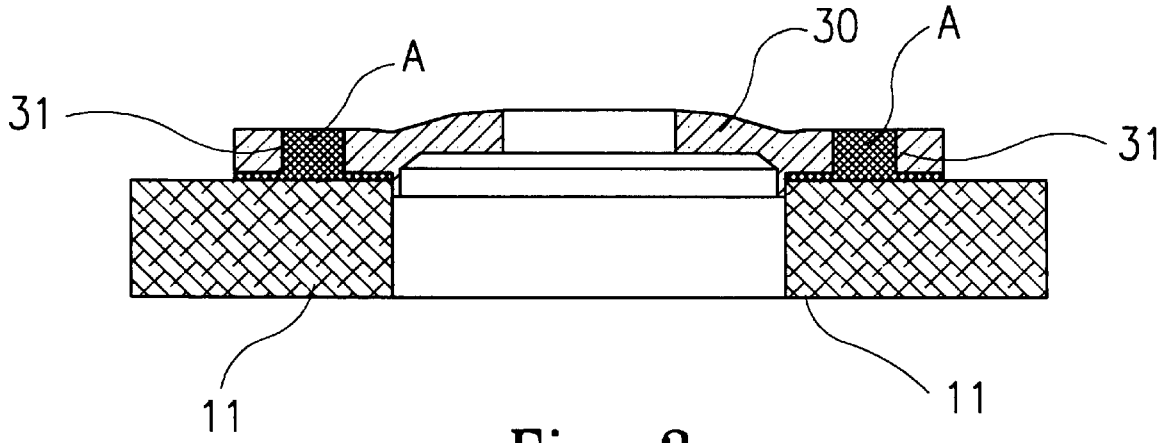
Fig. 3 PRIOR ART
FIG. 3 is a sectional view of the above another conventional turntable mounted on a nylon fiber grinding plate.
Figure 4:
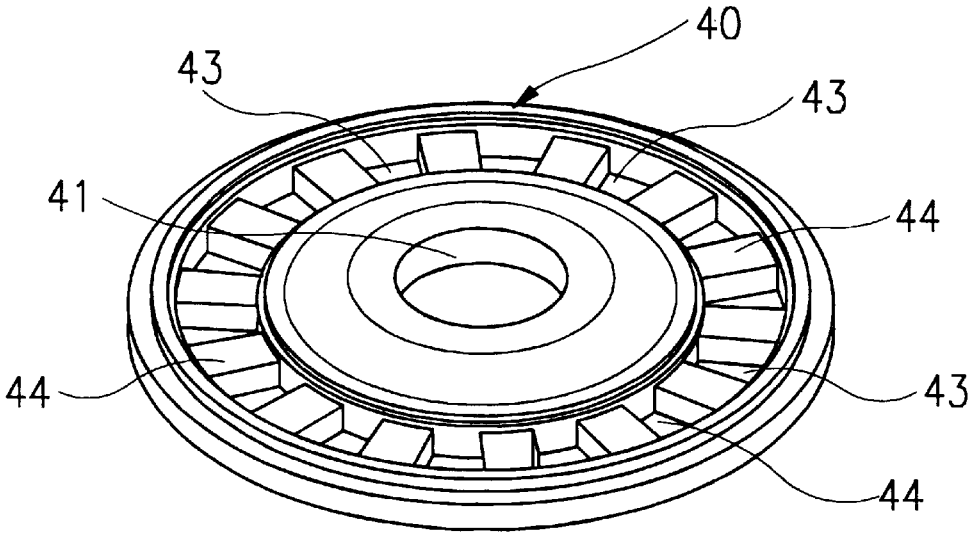
FIG. 4 is a perspective view of an improved turntable of a nylon fiber grinding wheel according to a first preferred embodiment of the present invention.
Figure 5:
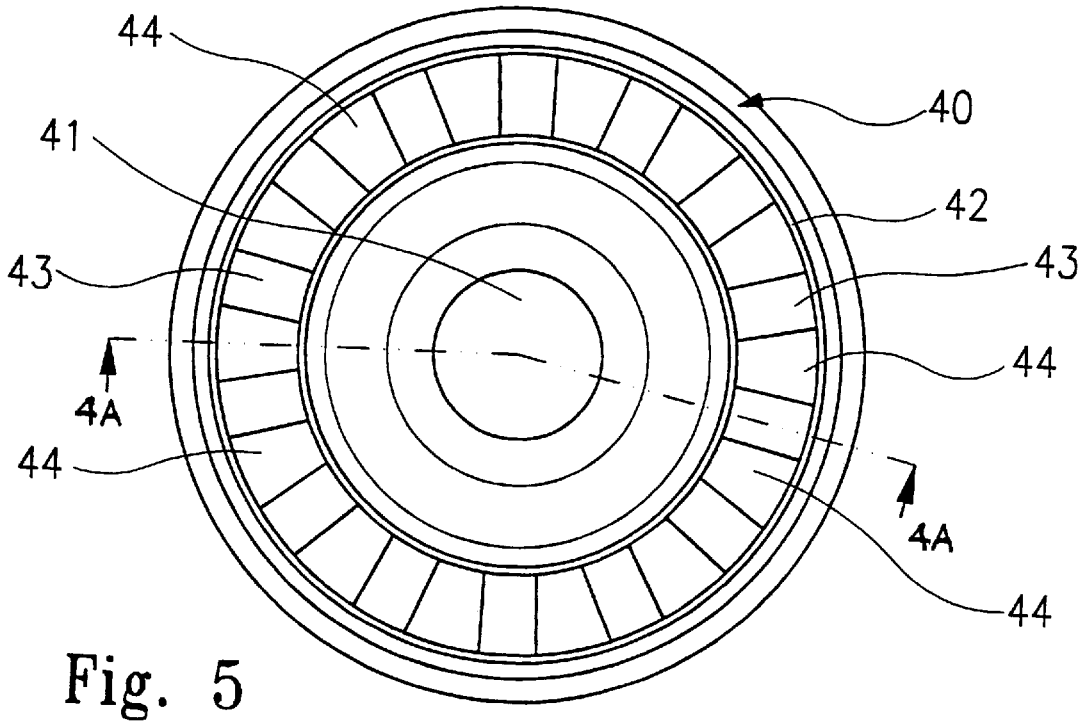
FIG. 5 is top view of the improved turntable of nylon fiber grinding wheel according to the above first preferred embodiment of the present invention.

Referring to FIGS. 4 and 5 of the drawings, an improved turntable of a nylon fiber grinding wheel according to a first preferred embodiment of the present invention is illustrated. The turntable 40 is integrally made of plastic by injection and has a predetermined amount of flexibility. The turntable 40 has a locking hole 41 provided at a center portion therethrough and a ring groove 42 encircling the locking hole 41 on a top surface of the turntable 40. The ring groove 42 has a plurality of through slot 43 arranged spacedly and radially thereon, and defines a plurality of ribs 44 arranged radially and respectively between the through slots 43 on the surface of the turntable 40.

Figure 6A:
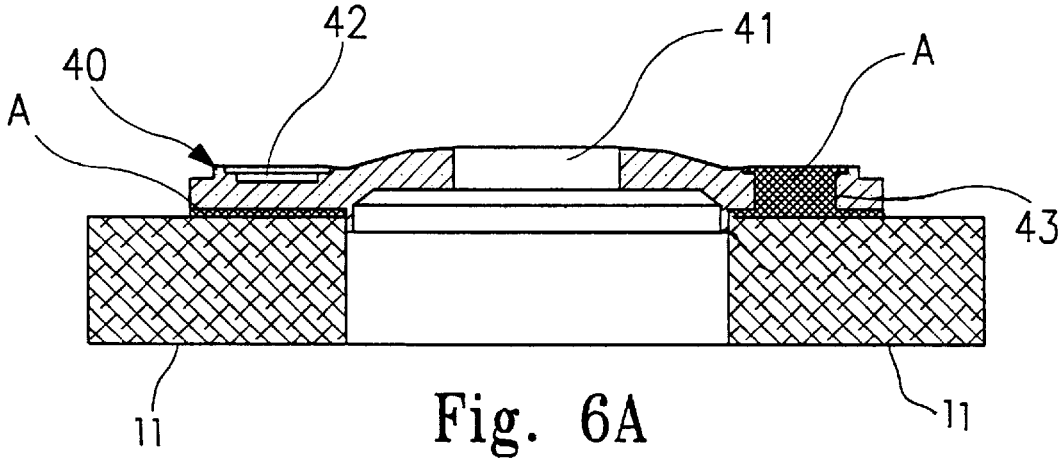
FIG. 6A is a sectional side view along section line A—A of FIG. 5 according to the above preferred embodiment of the present invention.
Figure 6B:
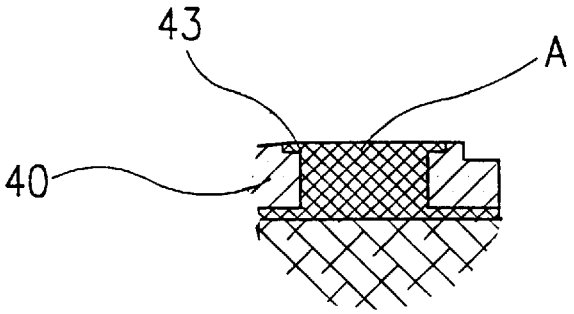
FIG. 6B is an enlarged sectional view of the encircled portion in FIG. 6A according to the above preferred embodiment of the present invention.

As shown in FIG. 6A, a bottom surface recess of the turntable 40 and the ring groove 42 are overfilled with a gluing agent A such as epoxy resin, wherein the gluing agent A would also fill in the plurality of through slots 43 and enwrap around the plurality of ribs 44. The nylon fiber grinding wheel further comprises a nylon fiber grinding plate which is mounted onto the bottom surface of the turntable 40 by means of the gluing agent A. As the gluing agent A is enwrapped around the plurality of ribs 44 and filled in the through slot 43, the solidified gluing agent A would be in an I-shape which ensures a rigid and tight connection between the turntable 40 and the nylon fiber grinding plate 11 as strong as being riveted. Therefore, the resistance force contract the torque force generated by the turning motion between the grinding surface and the working surface is increased, and thus the maximum turning speed of the whole nylon fiber grinding wheel can be also increased.

Figure 7:
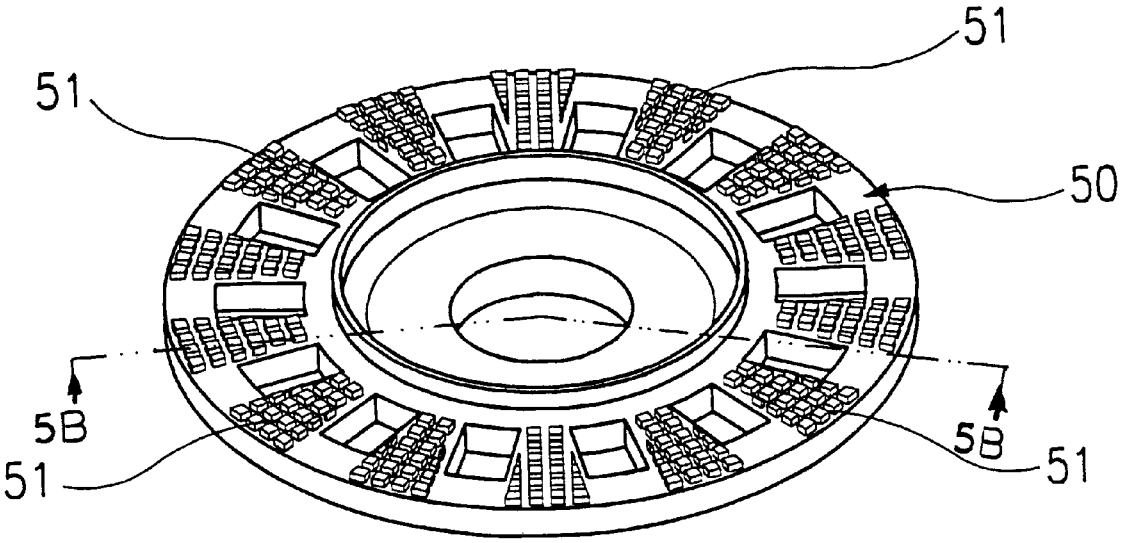
FIG. 7 is a perspective view of an improved turntable of nylon fiber grinding wheel according to a second preferred embodiment of the present invention.
Figure 8A:
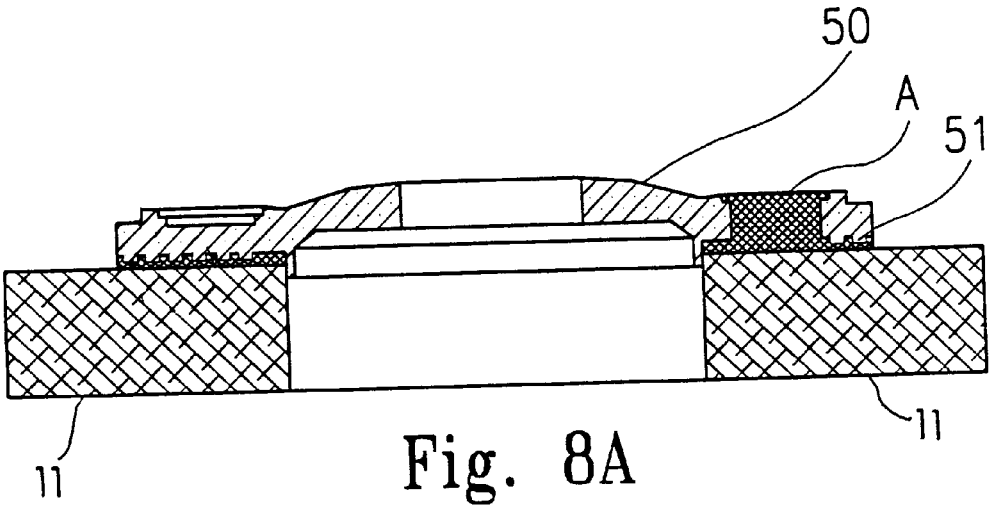
FIG. 8A is a sectional side view along section line B—B of FIG. 7 according to the above preferred embodiment of the present invention.
Figure 8B:
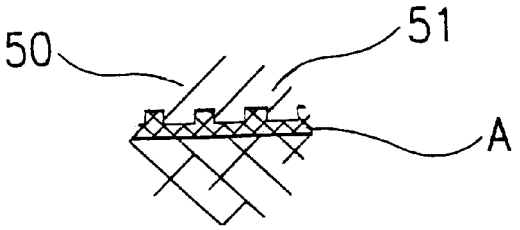
FIG. 8B is an enlarged sectional view of the encircled portion in FIG. 8A according to the above preferred embodiment of the present invention.

Referring to FIGS. 7 and 8 of the drawings, an improved turntable of a nylon fiber grinding wheel according to a second preferred embodiment of the present invention is illustrated. The turntable 50 of the second preferred embodiment further provides a plurality of protruding teeth 51 evenly distributed on a bottom surface thereof. The protruding teeth 51 integrally provides more surface contact area between the turntable 50 and the gluing agent A to enhance the grabbing ability therebetween (as shown in FIG. 8B). The resistance force to the torque force is thus increased due to such stronger bonding ability between the gluing agent A and the turntable 50.

However, as the nylon fiber grinding plate 11 continues to grind away on the working surface. The nylon fiber that is in contact with the working surface would be worn off and starts to give out from an outer periphery of the grinding body.

Figure 9:
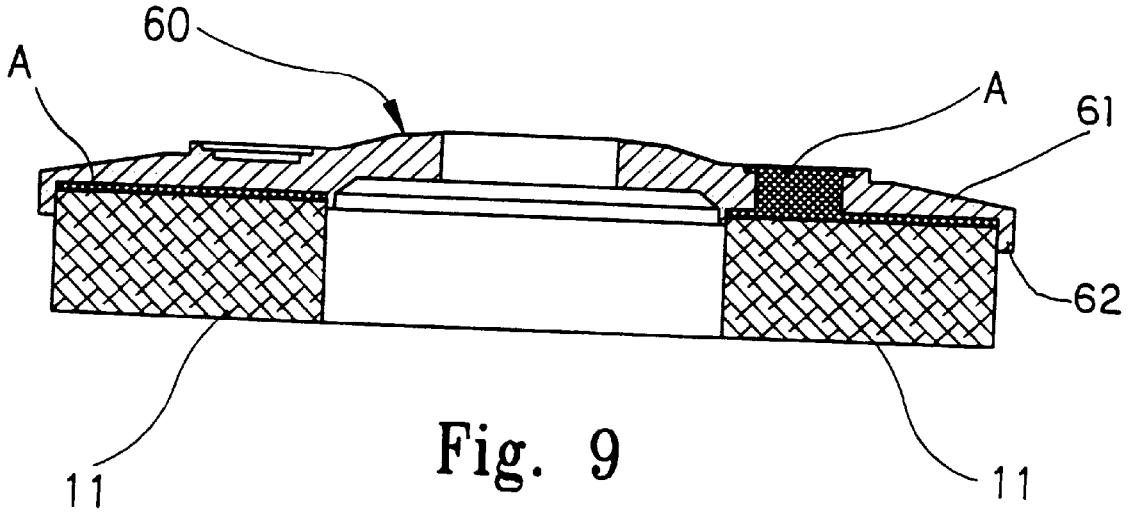
FIG. 9 is a sectional end view of an improved turntable of a nylon fiber grinding wheel according to a third preferred embodiment of the present invention.

Accordingly, the present invention provides a third preferred embodiment that can solve this problem, as shown in FIG. 9 of the drawing, wherein a turntable 60 further provides an outer periphery portion 61 extended outwardly and ended with a vertically extended circular covering rim 62. With the addition of the outer periphery portion 61 and the circular covering rim 62, the contact area between the turntable 60 and the gluing agent A has greatly increased, and thus the bonding force therebetween also increases. Therefore the resistance force to contract the torque force is enhanced. The circular covering rim 62 of the turntable 60 disposed on the outer surface of the nylon fiber grinding plate 11 further provideds an unexpected result, that is the circular covering rim 62 of the turntable 60 serves as a cover wall to cover an outer periphery surface of the nylon fiber grinding plate 11, thus preventing the slip off of the structure. This type of arrangement not only can reduce the chance of the outer periphery of the nylon fiber grinding plate 11 to give out, but also can slow down the worn off speed of the nylon fiber. The life span of the nylon fiber grinding plate 11 can be extended so that the working effectiveness and efficient can be enhanced too.

I claim:

1. An improved turntable of a nylon fiber grinding wheel, comprising a turntable, which is integrally made of flexible plastic, having a top surface, a locking hole provided at a center portion of said top surface, and a ring groove encircling said locking hole on said top surface of said turntable;

said ring groove having a plurality of through slots arranged circumferentially around said ring groove with respect to said ring groove, and defining a plurality of ribs arranged respectively and radially between said through slots;

said turntable having a bottom surface recess, wherein said bottom surface recess and said ring groove being overfilled with a gluing agent, wherein said gluing agent is filled in said plurality of through slots and extended around said plurality or ribs; and said nylon fiber grinding wheel further comprising a nylon fiber grinding plate which is mounted on said bottom surface of said turntable by means of said gluing agent, wherein said gluing agent filled in said through slots is solidified in an I-shape to ensure a rigid and tight connection between said turntable and said nylon fiber grinding plate.

2. An improved turntable of a nylon fiber grinding plate, as recited in claim 1, wherein said turntable further integrally provides a plurality of protruding teeth evenly distributed on said bottom surface thereof.

3. An improved turntable of a nylon fiber grinding plate, as recited in claim 1, wherein said turntable further provides an outer periphery portion extended outwardly and ended with a vertically extended circular covering rim to increase a contact area between said turntable and said gluing agent as well as said nylon fiber grinding plate.

4. An improved turntable of a nylon fiber grinding plate, as recited in claim 2, wherein said turntable further provides an outer periphery portion extended outwardly and ended with a vertically extended circular covering rim to increase a contact area between said turntable and said gluing agent as well as said nylon fiber grinding plate.

* * * * *